US008747191B2

(12) United States Patent
Kishi et al.

(10) Patent No.: US 8,747,191 B2
(45) Date of Patent: Jun. 10, 2014

(54) ENDLESS BELT TYPE GRINDING TOOL

(75) Inventors: Katsunobu Kishi, Tokyo (JP); Kuniaki Shibuya, Tokyo (JP); Yasumasa Suzuki, Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 851 days.

(21) Appl. No.: 12/526,379

(22) PCT Filed: Feb. 7, 2008

(86) PCT No.: PCT/JP2008/052049
§ 371 (c)(1),
(2), (4) Date: Aug. 7, 2009

(87) PCT Pub. No.: WO2008/096823
PCT Pub. Date: Aug. 14, 2008

(65) Prior Publication Data

US 2011/0009038 A1 Jan. 13, 2011

(30) Foreign Application Priority Data

Feb. 9, 2007 (JP) ..... 2007-031044

(51) Int. Cl.
*B24B 23/06* (2006.01)
*B24B 21/00* (2006.01)

(52) U.S. Cl.
USPC ..... 451/311

(58) Field of Classification Search
USPC ..... 451/311, 296, 355, 489
See application file for complete search history.

(56) References Cited

U.S. PATENT DOCUMENTS

| | | | | |
|---|---|---|---|---|
| 1,773,077 | A * | 8/1930 | Newman | 15/28 |
| 3,465,479 | A | 9/1969 | Foody et al. | |
| 3,611,646 | A | 10/1971 | Cameron et al. | |
| 3,643,385 | A * | 2/1972 | Mikiya | 451/355 |
| 5,235,784 | A * | 8/1993 | Oki et al. | 451/355 |
| 6,916,235 | B2 * | 7/2005 | Mikiya et al. | 451/296 |

FOREIGN PATENT DOCUMENTS

| | | |
|---|---|---|
| FR | 2 566 307 | 12/1985 |
| JP | 56-28847 | 3/1981 |
| JP | 4-73455 | 6/1992 |

(Continued)

OTHER PUBLICATIONS

International Search Report issued May 13, 2008 in the International (PCT) Application No. PCT/JP2008/052049.

(Continued)

*Primary Examiner* — Robert Rose
(74) *Attorney, Agent, or Firm* — Wenderoth, Lind & Ponack, L.L.P.

(57) ABSTRACT

In an endless belt type grinding tool, a tension bar includes a front portion and a rear portion which are divided from each other in a tubular holding portion. The front portion and the rear portion forcibly abut against each other when the endless grinding belt wound around the drive pulley and the idle pulley is applied with a tension by the spring. The endless belt type grinding tool includes a locking member which, when the tension bar is pushed into the tubular holding portion against the spring, engages with the rear portion of the tension bar to retain the rear portion at the pushed position against the urging force of the spring. Thus, in a state in which the grinding belt is removed, it is possible to reduce damage even if the tension bar, which is being pushed in, accidentally jumps out.

11 Claims, 3 Drawing Sheets

(56) References Cited

FOREIGN PATENT DOCUMENTS

| | | |
|---|---|---|
| JP | 2004-58216 | 2/2004 |
| JP | 3826133 | 7/2006 |
| TW | 1276499 | 9/1995 |

OTHER PUBLICATIONS

Taiwanese Office Action (along with a concise explanation in English) issued Feb. 11, 2011 in Application No. 10020097490.

* cited by examiner

ENDLESS BELT TYPE GRINDING TOOL

THIS APPLICATION IS A U.S. NATIONAL PHASE APPLICATION OF PCT INTERNATIONAL APPLICATION PCT/JP2008/052049, FILED Feb. 7, 2008.

BACKGROUND OF THE INVENTION

I. Technical Field

The present invention relates to an endless belt type grinding tool configured to grind an object by rotationally driving an endless grinding belt and pressing the endless grinding belt against the object.

II. Description of the Related Art

FIG. 1 shows a general structure of an endless belt type grinding tool. As shown in the figure, the tool includes a body 12 with a built-in air motor 10, a drive pulley 14 mounted on the body and driven by the motor, a tubular holding portion 16 extending forward from the body 12 in a direction perpendicular to a rotational axis of the drive pulley 14 (in the leftward direction in the figure), a tension bar 18, which is inserted rearward from the front end of the tubular holding portion into the tubular holding portion and extending forward from the front end, an idle pulley 20, which is mounted on the distal end of the tension bar, an endless grinding belt 22, which is wound between the idle pulley and the drive pulley, and a coil spring 24, which is disposed in the tubular holding portion 16 and urging the tension bar 18 forward to the illustrated position to apply tension to the endless grinding belt 22. The tool grinds a workpiece by rotationally driving the endless grinding belt 22 by means of the air motor 10 and pressing the endless grinding belt against the workpiece.

The endless belt type grinding tool also has a locking member 26, which is used when the grinding belt 22 is replaced. The locking member 26 is formed of a rectangular metal sheet bent into an L shape. The locking member 26 includes an inner portion 26-2, which is disposed so as to traverse the tension bar 18 and has an opening 26-1 through which the tension bar passes, and an outer portion 26-3, which is extending perpendicularly from the inner portion so as to be exposed on a surface of the body of the endless belt type grinding tool such that an operator can push the outer portion. The locking member 26 is urged by means of a spring member (not shown) such that the outer portion 26-3 is urged toward the outer side of the body 12 (the lower side in the figure). When the tension bar 18 is pushed from the illustrated position against the coil spring 24 and then an annular groove 18-1 formed on the outer peripheral surface of the tension bar aligns with the opening 26-1 of the locking member, the edge of the opening 26-1 is moved by the spring member so as to engage with the annular groove 18-1, whereby the locking member retains the tension bar against the coil spring 24.

When the grinding belt 22 is replaced, the tension bar 18 is pushed against the coil spring 24 into the tubular holding portion 16 from the state shown in FIG. 1, and then the tension bar is locked by means of the locking member 26. Thus, the distance between the idle pulley and the drive pulley is decreased, whereby the tension of the endless grinding belt is removed. In this state, the endless grinding belt is removed from the pulleys, and then a new endless grinding belt is wound around the pulleys. After that, the outer portion 26-3 of the locking member 26 is pushed in to release the tension bar 18 locked by the locking member 26. Then, the tension bar is pushed forward by means of the coil spring 24 to apply tension to the new endless grinding belt.

An example of such endless belt type grinding tools is disclosed in Japanese Patent No. 3826133.

SUMMARY OF THE INVENTION

In a practical belt replacement operation, an operator might push the locking member 26 in by mistake in a state in which the belt is removed, resulting in the release of the tension bar 18 locked by the locking member 26. In this case, the tension bar 18 is strongly pushed forward by the coil spring 24. The tension bar 18 is provided at the rear end thereof with a sliding portion 18-2, which slidably engages with the inner peripheral surface of the tubular holding portion. Therefore, the sliding portion 18-2 strongly collides against the locking member 26, and more specifically, against the peripheral portion of the opening 26-1 in the inner portion 26-2 of the locking member. If such a collision occurs many times, either or both of the peripheral portion of the opening 26-1 of the locking member 26 and the sliding portion 18-2 of the tension bar 18 might be damaged, especially in a large-sized endless belt type grinding tool having a large and heavy tension bar.

In view of the foregoing, it is an object of the present invention to provide an endless belt type grinding tool in which such damage can be prevented even if an operator performs the above-described wrong operation.

Means for Solving the Problems

The present invention therefore provides an endless belt type grinding tool including a body; a drive pulley which is amounted on the body; a tubular holding portion extending forward from the body in a direction perpendicular to a rotational axis of the drive pulley; a tension bar which is inserted rearward from the front end of the tubular holding portion into the tubular holding portion and extending forward from the front end; an idle pulley which is mounted on the distal end of the tension bar; an endless grinding belt wound around the drive pulley and the idle pulley and extending along the tension bar; and a spring which is disposed in the tubular holding portion and urging the tension bar forward to apply tension to the endless grinding belt. The tension bar includes a front portion and a rear portion which are divided from each other in the longitudinal direction in the tubular holding portion. The front portion and the rear portion forcibly abut against each other when the endless grinding belt wound around the drive pulley and the idle pulley is applied with a tension by the spring. The endless belt type grinding tool has a locking member, which, when the tension bar is pushed into the tubular holding portion against the spring, engages with the rear portion of the tension bar to retain the rear portion at the pushed position against the urging force of the spring.

In this endless belt type grinding tool, the tension bar is divided into the front portion and the rear portion. Therefore, in a state in which the tension bar is pushed in and the grinding belt is removed for belt replacement, even if an operator releases the tension bar locked by the locking member by mistake, and thus the tension bar is pushed out by the urging force of the spring and then a part of the rear portion of the tension bar collides with the locking member, as described above, the impact force is a function of the weight of only the rear portion. Therefore, the impact force can be significantly reduced compared with the conventional tension bar in which the front portion and the rear portion are formed integrally and thus the impact force is a function of the overall weight of the tension bar.

Specifically, the endless belt type grinding tool may be arranged as follows. The tension bar is provided with a flange portion at the front end of the rear portion thereof. The spring is disposed in the tubular holding portion so as to surround the rear portion. The spring is a coil spring configured to engage at the front end thereof with the flange portion. The rear end surface of the front portion of the tension bar abuts against the front end surface of the flange portion.

More specifically, the endless belt type grinding tool may be arranged as follows. The rear portion of the tension bar has a concave portion on the outer peripheral surface thereof. The locking member is disposed rearward of the concave portion of the rear portion in a state in which tension is applied to the grinding belt. The locking member is urged transversely with respect to the rear portion to engage with the outer peripheral surface of the rear portion. When the tension bar is pushed rearward against the spring to a position where the concave portion aligns with the locking member, the locking member engages with the concave portion to retain the rear portion at the position against the urging force of the spring, and is disengaged from the concave portion by being moved against the transverse urging force.

BEST MODE FOR CARRYING OUT THE INVENTION

Figure 1:
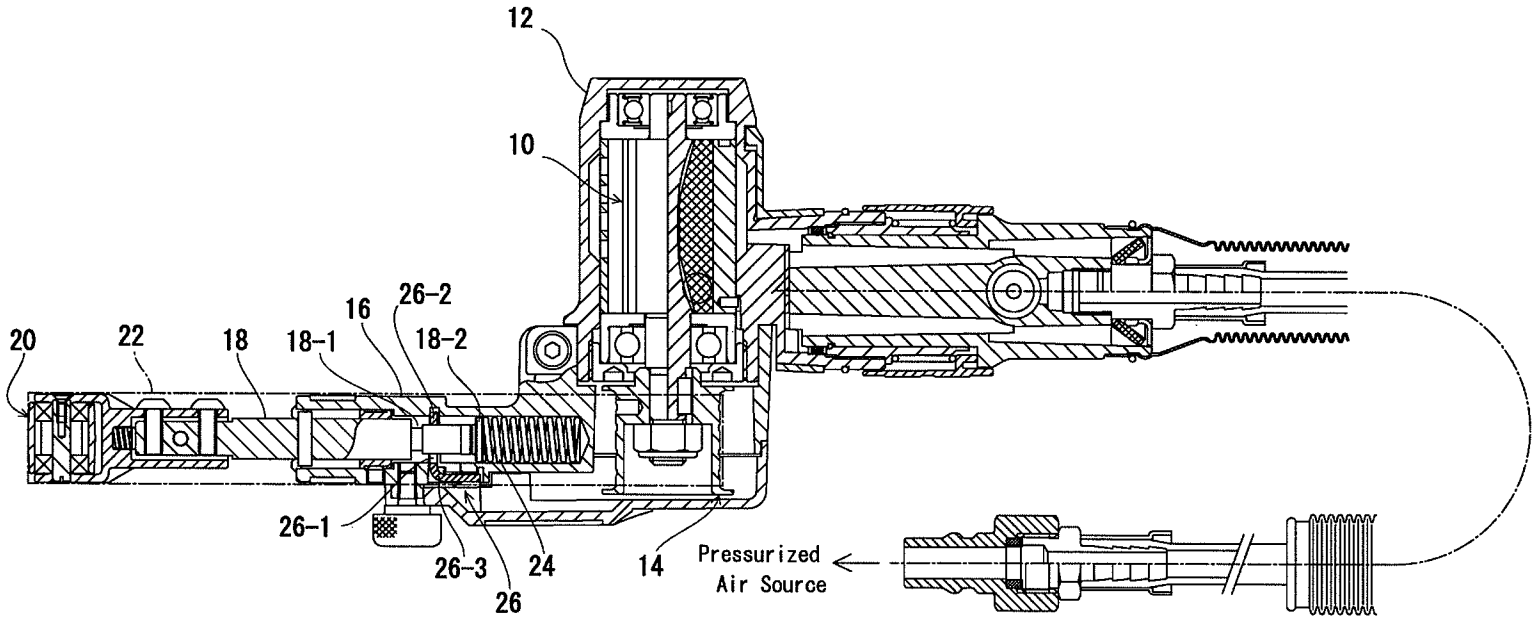
FIG. 1 is a longitudinal sectional plan view of a general-purpose endless belt type grinding tool.

An endless belt type grinding tool according to an embodiment of the present invention will now be described with reference to FIGS. 2 and 3. In the following description, like reference numerals are used to indicate like structural elements in the above-described endless belt type grinding tool according to the conventional art.

Figure 2:
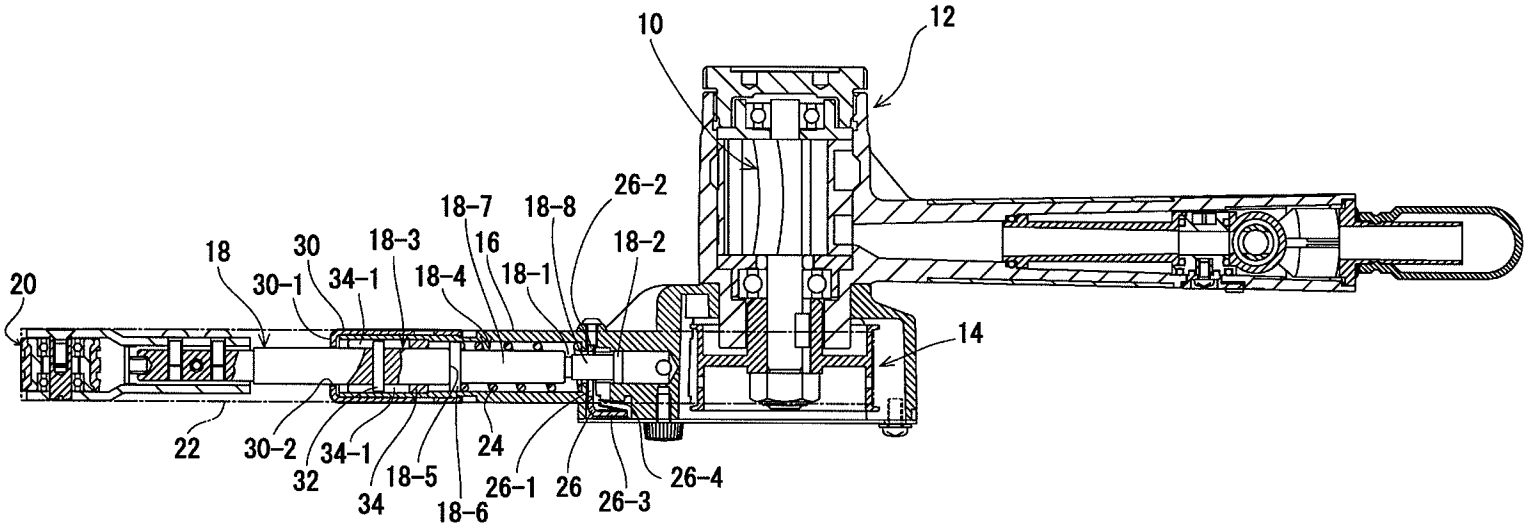
FIG. 2 is a longitudinal sectional plan view of an endless belt type grinding tool according to an embodiment of the present invention.
Figure 3:
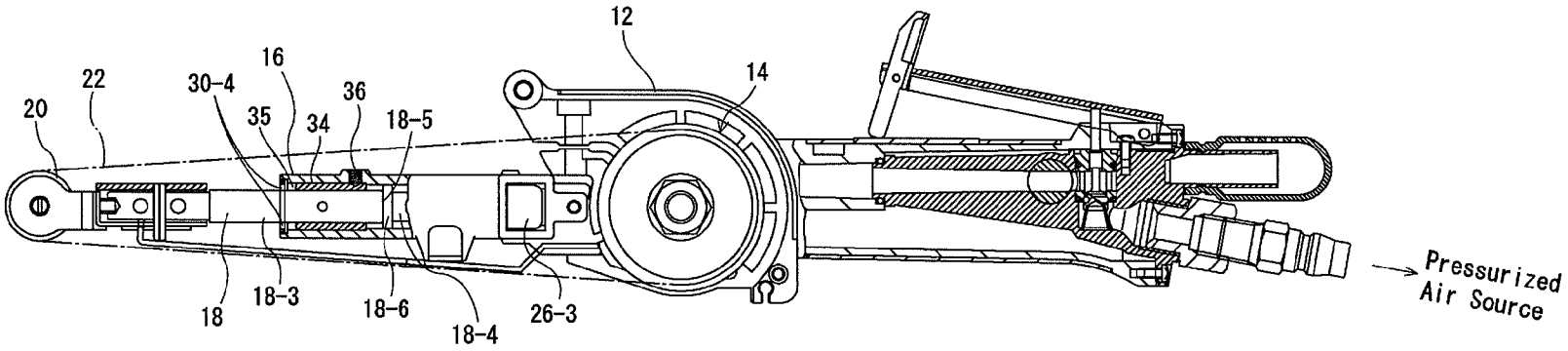
FIG. 3 is a partial sectional side view of the endless belt type grinding tool in FIG. 2.

As shown in FIG. 2, the basic configuration of the endless belt type grinding tool according to the present invention is the same as that of the conventional tool shown in FIG. 1. The endless belt type grinding tool according to the present invention includes a body 12 with a built-in air motor 10, a drive pulley 14, which is mounted on the body and driven by the air motor, a tubular holding portion 16, extends forward from the body 12 in a direction perpendicular to a rotational axis of the drive pulley 14 (in the leftward direction in the figure), a tension bar 18, which is inserted rearward from the front end of the tubular holding portion into the tubular holding portion and extending forward from the front end, an idle pulley 20, which is mounted on the distal end of the tension bar, an endless grinding belt 22, which is wound between the idle pulley and the drive pulley, a coil spring 24, which is disposed in the tubular holding portion 16 and urges the tension bar 18 forward to the illustrated position to apply tension to the endless grinding belt 22, and a locking member 26 which, when the tension bar is pushed from the illustrated position into the tubular holding portion to a predetermined position against the coil spring, engages with the tension bar to retain the tension bar against the urging force of the coil spring 24.

Similarly to the above-described conventional tool, the locking member 26 is formed of a rectangular metal sheet bent into an L shape. The locking member 26 has an inner portion 26-2 disposed so as to traverse the tension bar 18 and having an opening 26-1 through which the tension bar passes, and an outer portion 26-3 extending perpendicularly from the inner portion so as to be exposed on a surface of the body of the endless belt type grinding tool such that an operator can push the outer portion. The locking member 26 is urged by means of a coil spring 26-4 such that the outer portion 26-3 is urged toward the outer side of the body 12 (the lower side in the figure). In the illustrated state, the peripheral portion of the opening 26-1 of the inner portion 26-2 (the upper portion of the periphery of the opening in FIG. 2) is in engagement with the outer peripheral surface of the tension bar 18. When the tension bar is pushed in against the coil spring 24 and then an annular groove 18-1 formed on the outer peripheral surface of the tension bar aligns with the opening 26-1 of the locking member, the peripheral portion of the opening 26-1 is moved by the coil spring 26-4 so as to engage with the annular groove 18-1.

This endless belt type grinding tool has the following characteristics.

The tension bar 18 is divided into a front portion 18-3 and a rear portion 18-4 in the tubular holding portion 16, and an annular groove 18-1 is formed in the rear portion 18-4. Specifically, the front portion 18-3 has a rear end surface 18-5, and the rear portion 18-4 has a flange portion 18-6 at the front end thereof. The rear end surface 18-5 of the front portion 18-3 and the front end surface of the flange portion 18-6 of the rear portion 18-4 are in abutment with each other. The rear portion 18-4 has a front section 18-7 between the flange portion 18-6 and the annular groove 18-1, and a rear section 18-8 disposed rearward of the annular groove 18-1. The rear portion 18-4 also has, at the rear end of the rear section 18-8, a sliding portion 18-2 slidable along the inner peripheral surface of the tubular holding portion. The coil spring 24 is in engagement with the flange portion 18-6. In the illustrated state in which the locking member 26 is not in engagement with the annular groove 18-1, the coil spring 24 pushes the rear portion 18-4 and the front portion 18-3 of the tension bar 18 forward, thereby applying tension to the endless grinding belt 22 wound around the drive pulley 14 and the idle pulley 20. In this state, the rear end surface 18-5 of the front portion 18-3 and the front end surface of the flange portion 18-6 of the rear portion 18-4 forcibly abut against each other.

In the figure, reference numeral 30 denotes a U-shaped member having an end wall 30-1 and disposed so as to close a front end opening of the tubular holding portion 16. The end wall 30-1 is provided with an opening 30-2 through which the front portion 18-3 of the tension bar 18 passes, and notches 30-4, 30-4 (FIG. 3) extending outwardly in the radial direction from diametrically opposed points on the periphery of the opening 30-2 so that both ends of a pin 32 disposed in the front portion 18-3 of the tension bar 18 so as to traverse the front portion can pass through the notches. Reference numeral 34 denotes a tubular member (i.e. a stopping member) inserted into the tubular holding member 16 so as to contact with the inner surface of the tubular holding member and fixed by a screw 36 which threads into and engages a threaded hole formed in the tubular holding portion 16, the threaded hole extending radially. The tubular member has an opening through which the front portion 18-3 of the tension bar 18 passes, and a pair of slots 34-1, 34-1 (FIG. 2) through which the both ends of the pin 32 disposed in the front portion 18-3 pass in the longitudinal direction. The slots 34-1, 34-1 are configured so as not to align, in the longitudinal direction, with the above-described notches 30-4, 30-4 (through which the pin 32 passes) disposed in the end wall 30-1. The front portion 18-3 of the tension bar is set such that the both ends of the pin 32 can slide in the slots 34-1. In order to pull the front portion 18-3 forward out of the tubular holding portion 16, it is necessary that the pin 32 be moved to a space 35 formed between the U-shaped member 30 and the distal end of the tubular member 34, and then rotated such that the both ends of the pin align with the notches 30-4, 30-4.

In grinding operation with this endless belt type grinding tool, the grinding belt 22 is pressed against a workpiece to grind the workpiece, with the grinding belt 22 tensioned and rotationally driven.

When the grinding belt 22 is replaced, the tension bar 18 is pushed rearward against the coil spring 24 in the same way as the above-described conventional tool. Thus, the locking member 26 engages with the annular groove 18-1 of the tension bar 18, whereby the rear portion 18-4 of the tension bar 18 is retained at the pushed position and the front portion 18-3 is in a tension-free state. In this state, the grinding belt 22 without tension is removed from the pulleys 14, 20, and then a new belt is wound around the pulleys. After that, the locking member 26 is pushed in to disengage from the annular groove 18-1 of the tension bar 18. Thus, the tension bar 18 is pushed forward by means of the coil spring 24 to apply tension to the grinding belt 22.

In this replacement operation of the belt, in a case where an operator pushes in the locking member 26 by mistake in the state where the belt is removed, and thus the tension bar is disengaged from the locking member and is then strongly pushed out by the coil spring 24, the sliding portion 18-2 disposed at the rear end of the tension bar collides against the periphery of the opening of the locking member 26 through which the tension bar passes, as is the case with the above-described conventional tool. In this endless belt type grinding tool, since the front portion 18-3 and the rear portion 18-4 are separated, the impact force between the periphery of the opening and the flange portion generated by the collision of the flange portion against the periphery is a function of the weight of the rear portion 18-4 of the tension bar. On the other hand, in the conventional tool, the impact force is a function of the overall weight of the tension bar in which the front portion and rear portion are integrally formed. Therefore, the impact force in the endless belt type grinding tool according to the present invention can be significantly reduced compared with that in the conventional tool. As a result, as described above, the problem in the conventional endless belt type grinding tool can be significantly eased.

The invention claimed is:

1. An endless belt grinding tool, comprising:

a body;

a drive pulley mounted on the body;

a holding portion extending forward from the body in a direction perpendicular to a rotational axis of the drive pulley;

a tension bar inserted into the holding portion rearward from a front end of the holding portion and extending forward from the front end;

an idle pulley mounted on a distal end of the tension bar;

an endless grinding belt wound around the drive pulley and the idle pulley and extending along the tension bar;

a spring disposed in the holding portion and being configured and arranged to urge the tension bar forward to apply tension to the endless grinding belt; and a locking member configured to engage the tension bar, wherein the tension bar includes a front portion and a rear portion which are divided from each other in a longitudinal direction in the holding portion, and the front portion and the rear portion forcibly abut against each other when the endless grinding belt wound around the drive pulley and the idle pulley is applied with tension by the spring, wherein the rear portion of the tension bar has on an outer peripheral surface thereof a concave portion, wherein the locking member is disposed rearward of the concave portion of the rear portion when tension is applied to the grinding belt, wherein the locking member is configured to be urged transversely with respect to the rear portion to engage with an outer peripheral surface of the rear portion, wherein the locking member is configured to engage the concave portion when the tension bar is pushed rearward against the spring to a position where the concave portion aligns with the locking member such that the rear portion is retained at the position against the urging force of the spring, and wherein the locking member is configured to disengage from the concave portion by being moved against the transverse urging force.

2. The endless belt grinding tool of claim 1, wherein the tension bar includes a rear section disposed rearward of the concave portion and a front section disposed forward of the concave portion, and wherein the rear section and the front section of the tension bar are configured and arranged such that the locking member engaged in the concave portion is retained at the position against the urging force of the spring in a forward direction and also retained against further movement in a backward direction opposite to the forward direction.

3. The endless belt grinding tool of claim 1, wherein:

the tension bar has a flange portion at a front end of the rear portion thereof;

the spring is disposed in the holding portion so as to surround the rear portion;

the spring is a coil spring configured to engage at the front end thereof with the flange portion; and a rear end surface of the front portion of the tension bar abuts against a front end surface of the flange portion.

4. The endless belt grinding tool of claim 1, wherein the front portion and the rear portion of the tension bar are separable.

5. The endless belt grinding tool of claim 1, wherein the locking member has an L shape.

6. An endless belt grinding tool, comprising:

a body;

a drive pulley mounted on the body;

a holding portion extending forward from the body in a direction perpendicular to a rotational axis of the drive pulley;

a tension bar inserted into the holding portion rearward from a front end of the holding portion and extending forward from the front end;

an idle pulley mounted on a distal end of the tension bar;

an endless grinding belt wound around the drive pulley and the idle pulley and extending along the tension bar;

a spring disposed in the holding portion and being configured and arranged to urge the tension bar in a forward direction to apply tension to the endless grinding belt; and a locking member configured to engage the tension bar, wherein the tension bar includes a front portion and a rear portion which are divided from each other in a longitudinal direction in the holding portion, and the front portion and the rear portion forcibly abut against each other when the endless grinding belt wound around the drive pulley and the idle pulley is applied with tension by the spring, wherein the rear portion of the tension bar has on an outer peripheral surface thereof a concave portion, wherein the locking member is disposed rearward of the concave portion of the rear portion when tension is applied to the grinding belt, wherein the locking member is configured to be urged transversely with respect to the rear portion to engage with an outer peripheral surface of the rear portion, wherein the locking member is configured to engage the concave portion when the tension bar is pushed rearward against the spring to a position where the concave portion aligns with the locking member such that the rear portion is retained at the position against the urging force of the spring, wherein the locking member is configured to disengage from the concave portion by being moved against the transverse urging force, wherein the front portion and the rear portion of the tension bar are separable, and wherein the tension bar has a flange portion at a front end of the rear portion thereof, and the flange portion is configured to limit movement of the tension bar in the forward direction.

7. The endless belt grinding tool of claim 6, wherein the tension bar includes a rear section disposed rearward of the concave portion and a front section disposed forward of the concave portion, and wherein the rear section and the front section of the tension bar are configured and arranged such that the locking member engaged in the concave portion is retained at the position against the urging force of the spring in a forward direction and also retained against further movement in a backward direction opposite to the forward direction.

8. The endless belt grinding tool of claim 6, wherein:

the spring is disposed in the holding portion so as to surround the rear portion;

the spring is a coil spring configured to engage at the front end thereof with the flange portion; and a rear end surface of the front portion of the tension bar abuts against a front end surface of the flange portion.

9. The endless belt grinding tool of claim 6, wherein the locking member has an L shape.

10. The endless belt grinding tool of claim 6, further comprising a stopping member disposed in the holding portion for limiting movement of the tension bar by blocking the flange portion.

11. The endless belt grinding tool of claim 10, wherein a rear end surface of the front portion of the tension bar abuts against a front end surface of the flange portion.

* * * * *